United States Patent [19]

Tomiati et al.

[11] 4,007,857

[45] Feb. 15, 1977

[54] SAFEGUARD CAP STRUCTURE PARTICULARLY FOR BOTTLES

[76] Inventors: Umberto Tomiati, Via D. Filippini, 19, Verona; Walter Boldrini, Via Monreale, 10, Milan, both of Italy

[22] Filed: Oct. 14, 1975

[21] Appl. No.: 621,923

[30] Foreign Application Priority Data

Apr. 10, 1975 Italy ..... 22236/75

[52] U.S. Cl. ..... 222/153; 222/182; 222/559

[51] Int. Cl.[2] ..... B67D 5/00

[58] Field of Search ..... 222/182, 153, 547, 501, 222/518, 559

[56] References Cited

UNITED STATES PATENTS

| | | | |
|---|---|---|---|
| 3,450,299 | 6/1969 | Barbera | 222/182 X |
| 3,804,301 | 4/1974 | Treanor | 222/182 X |

*Primary Examiner*—Stanley H. Tolberg
*Assistant Examiner*—Hadd Lane
*Attorney, Agent, or Firm*—Albert Josif; Guido Modiano

[57] ABSTRACT

Safeguard cap structure particularly for bottles, comprising a cylindrical hollow body which can be associated in sealing engagement with the neck of a bottle. A plurality of flexible reeds extending longitudinally in the hollow body in the proximity of the free edge thereof. A shut off disc supported by said reeds defines, in cooperation with the mentioned free edge, outlet ports for the issuing of a liquid from the bottle. A covering hood is in screwed engagement with the mentioned hollow body. A plurality of short and substantially rigid appendages and a plurality of long and substantially flexible appendages intervening between the short ones are part of the cap structure. The appendages extend radially from the periphery of the shut off disc, projections being provided peripherally along the inner bottom of the covering hood and adapted to engage the long and substantially flexible appendages during the rotation of the covering hood.

17 Claims, 11 Drawing Figures

SAFEGUARD CAP STRUCTURE PARTICULARLY FOR BOTTLES

BACKGROUND OF THE INVENTION

This invention relates to a safeguard cap structure, particularly for application to bottles.

There are known several types of safeguard caps, i.e. caps which while permitting a normal issue of the liquid contents out of the bottle, do not let in foreign liquids. Among such known caps are those provided internally with a valve which is movable by gravity, thus allowing the liquid to be poured out of the bottle when the latter is turned more or less upside down but preventing the admixture of foreign liquids when the bottle is in an upright position. Such caps, although generally satisfactory, are prone to sticking of the moving valve member owing to the formation of a crystalline colloidal deposit over the contact areas of the moving valve with its respective stationary seat. Another drawback of the prior art cap configurations is that they are made up of a comparatively high number of component parts, which brings about increased manufacturing and assembling costs.

Italian Patent No. 770,574, issued on June 1, 1960, to one of the applicants discloses a safeguard cap comprising a hollow body which can be associated in sealing engagement with the neck of a bottle, and is provided in the proximity of the upper free edge of said hollow body with a number of upward extending flexible uprights which support a shut off disc. In an open condition, between said free edge and said shut off disc there remain defined outlet ports for the issuing of the liquid from a bottle. When the covering hood is installed, this acts upon the shut off disc causing said flexible uprights to collapse, and the shut off disc to abut on said free edge, thereby a tight seal is achieved. When the cap is screwed out, the uprights extend resiliently upwards, thus uncovering the liquid outlet ports. The embodiment just described, although providing positive results both from a practical point of view and costwise, since it is made up, as it can be observed, of a very limited number of parts, presents a disadvantage in that, when the cap is left in a closed condition over extended periods of time, the elastic strain on the flexible uprights tends to convert into a plastic one, thus preventing the spontaneous lifting of the shut off disc after removal of the hood.

SUMMARY OF THE INVENTION

It is an object of this invention to overcome the prior art drawbacks by providing a safeguard cap structure comprising a small number of component parts, with beneficial effects on both the production cost and the assembling time and cost.

It is another object of the invention to provide a cap structure which can be assembled to the neck of a bottle by means of fully automated machines, thus favoring a reduction in the cap installation cost as well.

It is a further object of the invention to provide a safeguard cap which is reliable in operation, even after prolonged storage in a closed condition.

It is yet another object of the invention to provide a safeguard cap which can be conveniently made of commercially available materials, and which is highly competitive from the point of view of price.

These and other objects, such as will become more apparent hereinafter, are achieved according to this invention by a safeguard cap structure particularly for bottles, comprising a substantially cylindrical hollow body which can be associated in sealing engagement with the neck of a bottle, a threaded portion along the outer surface of said hollow body, a plurality of flexible reeds extending longitudinally in said hollow body in the proximity of the free edge thereof, a shut off disc supported by said reeds and defining, in cooperation with said free edge, outlet ports for the issuing of a liquid from said bottle, said shut off disc being adapted to abut on said free edge against the force by said reeds, a covering hood in screwed engagement with said threaded portion, said cup structure being characterized in that it comprises a plurality of short and substantially rigid appendages and a plurality of long and substantially flexible appendages intervening between the short ones, said appendages extending radially from the periphery of said shut off disc, projections being provided peripherally along the inner bottom of said covering hood and adapted to engage said long and substantially flexible appendages during the rotation of said covering hood.

BRIEF DESCRIPTION OF THE DRAWINGS

Further advantages and features will become apparent from the following description of a preferred though not exclusive embodiment of a safeguard cap structure according to the invention, illustrated by way of example and not of limitation in the accompanying drawings, wherein.

DESCRIPTION OF A PREFERRED EMBODIMENT

Figure 1:
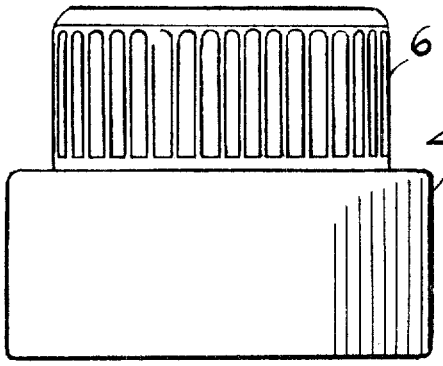
FIG. 1 is an elevational view of a cap structure according to the invention.
Figure 4:
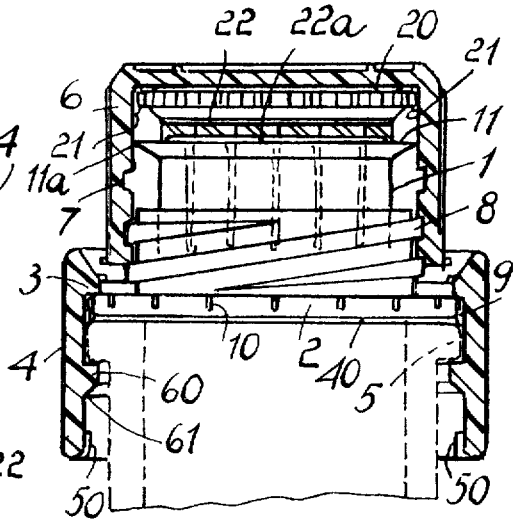
FIG. 4 shows, in longitudinal section, the cap during the bottle opening step.
Figure 2:
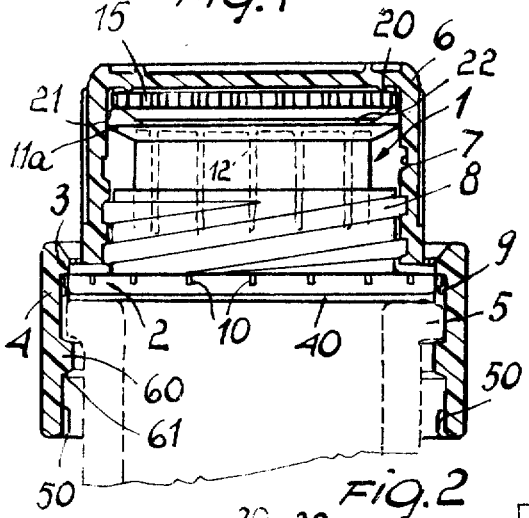
FIG. 2 is a longitudinal sectional view of the safeguard cap in its closed condition.
Figure 3:
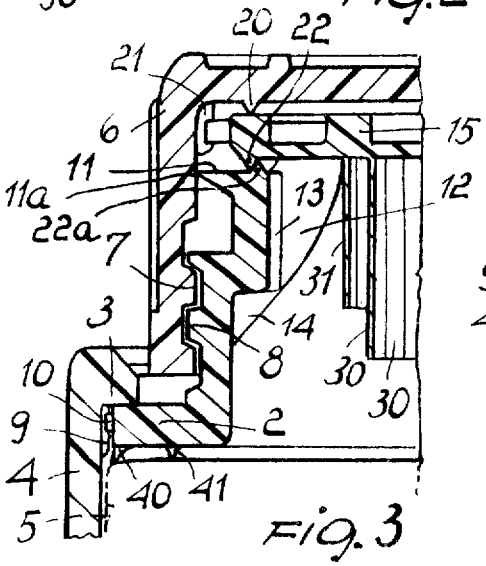
FIG. 3 is an enlarged detail view, in longitudinal section, of the cap in its closed condition.

With reference to the figures in the drawings, the inventive safeguard cap structure comprises a hollow body 1, substantially cylindrical, having a lower flange 2 which engages an annular mating portion 3 formed in a collar 4 which can be associated with the neck 5 of a bottle. With said collar 4, at an area mating the annular abutment portion 3, there is associated, by means of tear out spot bridges, a covering hood 6 which is provided internally with a female threaded portion 7 adapted for threadedly engaging a corresponding male threaded portion 8 provided at the outer surface of the hollow body 1. Of preference, both the threads 7 and 8 are of the long pitch type.

In the manufacturing process, the collar 4 and hood 6 are made into a single component and interconnected by means of said tear out spot bridges. The hollow body 1 is then inserted by screwing it into the hood 6, before the assembling of the collar to the neck of the bottle. In consideration of the fact that the sealing engagement is achieved through the pressure exerted by the annular portion 3 on the lower flange 2, it is indispensable that the hollow body 1, during the interval between the assembling of these two elements and bottle filling step, cannot rotate with respect to the collar 4, since, owing to the screwing of the threaded portion 8 in the threaded portion 7 of the hood 6, it would develop a tendency to separate from the annular portion 3, thus affecting the tightness of the seal after the collar 4 is mounted to the neck 5 of the bottle. In order to prevent such rotation, and especially a rotation in a clockwise direction of the hollow body 1 with respect to the collar 4, which rotation as mentioned already would cause the flange 2 to move away from the annular abutment portion 3, the collar 4 is provided with a plurality of sawtooth raised portions 9, which are spaced at equal intervals and engage with mating sawtooth appendages 10 provided along the outer edge of the annular flange 2. This form of coupling, which allows for an anticlockwise rotation of the flange 2 with respect to the collar 4, said rotation ensuring a tighter seal between the portion 3 and flange 2 and being thus a positive feature of the coupling, entirely prevents any clockwise rotation of the flange 2 with respect to the collar 4, thereby any risk of the hollow body 1 rotating inside the body 6 before the installation of the cap structure on the neck of a bottle is positively prevented.

In the proximity of the upper free edge or drop catcher 11 of the hollow body 1, and along the inside thereof, there is provided a plurality of flexible reeds 12 which extend longitudinally upwards and are arranged radially with respect to said hollow body 1. Such flexible reeds 12 are provided at the attachment area thereof to the hollow body 1 a longitudinal raised portion 13 having the function of an engagement element for an outside located automatic punch or mandrel (not shown in the drawings) designed for screwing said hollow body 1 inside the hood 6 associated in turn, as mentioned previously, to the collar 4 before the collar 4 is assembled to the neck 5 of a bottle.

Said upper free edge 11 extends outwards into an annular enlargement 11*a*, which by engaging the inner cylindrical surface of the covering hood 6 ensures a tight fitting against any incidental leak out when the hood 6 is screwed down onto the hollow body 1.

Figure 5:
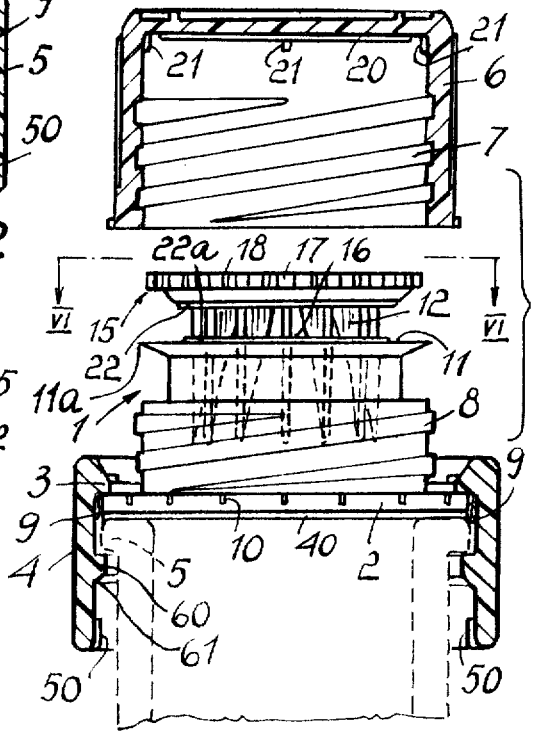
FIG. 5 shows the cap according to the invention in its opened condition, with some parts in longitudinal section.
Figure 6:
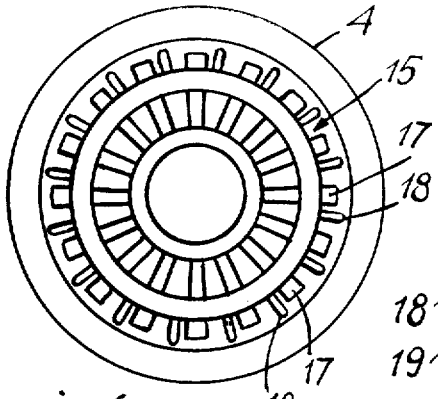
FIG. 6 is a view taken along the line VI—VI of FIG. 5.
Figure 9:
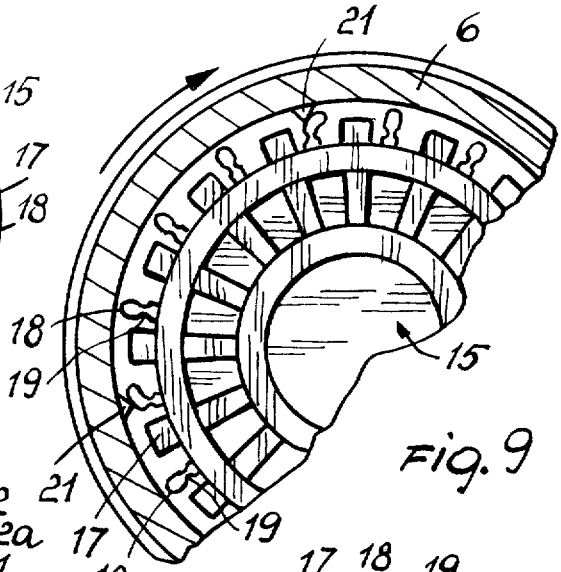
FIG. 9 is an enlarged view of the disc during the closing step.
Figure 7:
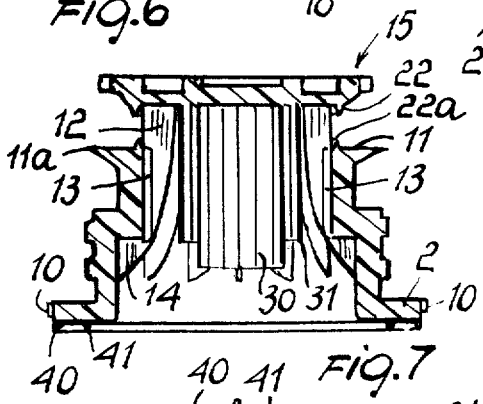
FIG. 7 shows the hollow body of the cap according to the invention, in longitudinal section and in the opened condition.
Figure 8:
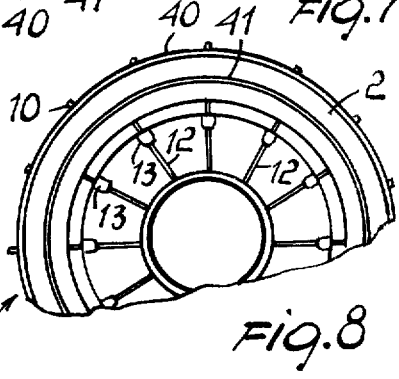
FIG. 8 shows the hollow body in plan bottom view.
Figure 10:
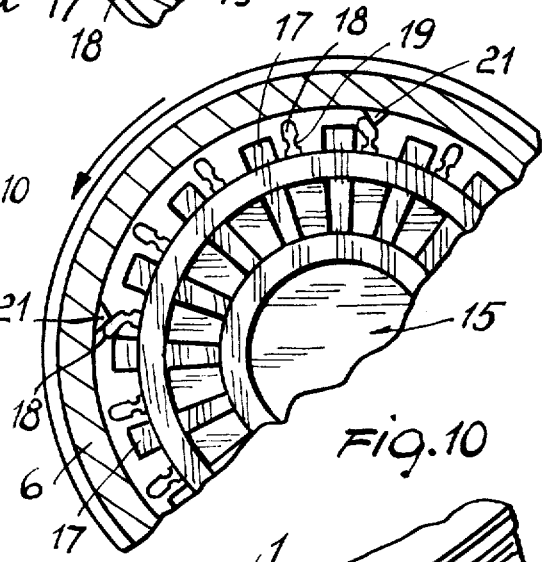
FIG. 10 is an enlarged view of the disc during the bottle opening step.
Figure 11:
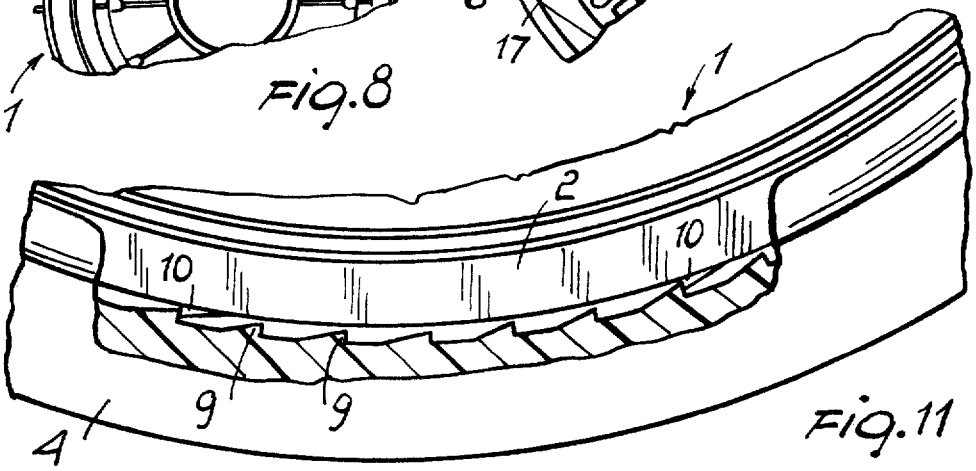
FIG. 11 is a much enlarged view of the abutment of the lower flange of the hollow body to the collar.

Said reeds 12 support a shut off disc 15, which defines, in cooperation with said free edge 11, outlet ports 16, see FIG. 5, for pouring out the liquid contained in the bottle when the hood 6 is removed.

Along the periphery of said shut off disc 15 there are provided a plurality of short appendages 17, essentially rigid, and a plurality of essentially flexible long appendages 18, intervening one another and extending radially from said shut off disc 15. Furthermore, in the proximity of their roots, the appendages 18 present superimposed notches 19, which by reducing the working section of the appendages 18, increase considerably the flexibility thereof. More precisely, the long appendages 18 are located close by the short appendages 17 which come before them in a clockwise direction, such that the spacing of the long appendages 18 from the short ones located ahead of the former is less than the spacing from the short appendages following them in a clockwise direction.

It should be added to the foregoing that the hood 6 is provided, at its inner bottom, with an annular ridge 20 acting as a thrust member, which has the function of causing the hood 6 to compress the disc 15 along a restricted area; furthermore, the hood 6 is provided peripherally along its inner bottom with projections 21, four in the embodiment shown, which are adapted to engage the long appendages 18 during the rotation of the hood 6.

On the lower face of the disc 15, at the annular thrust ridge 20, there is provided a first sealing lip 22 of annular configuration, which acts upon a second annular sealing lip 22*a* provided on the upper free edge 11 of the hollow body 1. In other words, the second annular sealing lip 22*a* has a slightly smaller diameter than the first annular sealing lip 22, such that when the disc 15 approaches the free edge 11 there is formed, owing to the contact engagement of the first lip 22 with the second lip 22*a*, a sealing ring which prevents any leak out of the bottle liquid contents.

It should be noted, moreover, that inside the covering hood 6, a portion of the inner lateral surface of the hood 6, said annular enlargement 11*a*, and the fit of the first annular sealing lip 22 with the second annular sealing lip 22*a* together define an intermediate pneumatic ring of toroidal configuration; thereby, a doughnut air chamber is created which further contributes to the tightness of the sealing assembly.

From said shut off disc 15, and inwards with respect to the hollow body 1, there extend longitudinally a first set of elongated, thin and flexible tabs 30, which are arranged along a circumference and adjacent to one another. Moreover, a second set of flexible tabs 31 may be provided which are arranged along a concentric circumference laying external with respect to the circumference of the tabs 30. The tabs 31 are so arranged as to be offset with respect to the tabs 30, i.e. the contact areas of the tabs 31 to one another do not match the tab 30 areas of reciprocal contact. The tabs 30 and 31 serve the purpose of preventing the liquid contents of the bottle from bursting out with force in the event that, in order to pour out the liquid, the bottle is suddenly turned upside down. In fact, under the impact by the liquid mass, the tabs bend outwards, thus occluding the ports 16; on completion of this step, which may be termed as "dynamic", the tabs, thanks to their inherent resiliency, tend to recover their initial position, thus allowing a smooth issue of the liquid out of the bottle. It should be noted that the tabs 31 which are arranged offset along the outer circumference have the function of closing the spaces left vacant by the tabs 30 arranged along the inner circumferences. It is to be added, moreover, that if desired the sets of tabs 30 and 31 may be replaced with a hollow cylindrical surface extending inwards with respect to the hollow body from the disc 15.

On the lower face of the annular flange 2, i.e. on the portion contacting the upper part of the neck 5 of the bottle, there is provided an outer annular edge which, when to the neck 5 of the bottle a collar member is applied, is thrust between the neck 5 and collar 4, thereby ensuring a tight non-rotatable fit between the hollow body 1, collar 4 and neck 5 of the bottle. An inner annular edge 41 is also provided concentrically to said outer edge 40, and serves achieve tightness between the flange 2 and neck 5.

Projections 50 are provided along the inner surface of the collar 4, in the proximity of its lower end, which have the function of permitting the collar 4 to be positioned, and consequently the positioning of the hood 6 and hollow body 1, associated thereto as previously described, on the neck 5 of the bottle. The projection 50 allows a first press fit of the collar 4 on the neck 5, before the pass under the automatic machine effecting the permanent mounting of the collar 4 to the neck 5. At an intermediate portion of the inner surface of the collar 4, an annular ridge 60 is provided which presents at the bottom a sloping invitation surface 61 which is effective to render the fit of the collar 4 to the neck 5 of the bottle a positive one.

It will now be explained how the cap according to the invention is utilized. The application of the cap structure according to the invention to the neck of a bottle will be considered first. As already stated hereinabove, the collar 4 is joined to the hood 6 by means of tear away spot bridges inside which the hood body 1 is pre-installed. This assembly is first mounted as a press fit to the bottle neck, by engagement of said longitudinal projections 50 with the neck 5, then an automatic machine joins them permanently, by engaging under pressure said annular ridge 60 with the neck 5 of the bottle. With this operation, the cap structure is permanently associated to the bottle neck. It should be noted, once more, that as previously mentioned hereinabove, the outer edge 40 provided on the flange 2 is effectively thrust in between the neck 5 and collar 4, thus preventing any shifting of the parts; furthermore, the inner edge 41 ensures a tight seal between the flange 2 in the hollow body 1 and the collar 5.

It will now be described how the cap is utilized, once it has been mounted to the bottle. With the cap in the closed position, the disc 15 is compressed downwards such that the first sealing lip 22 effects a seal connection, by surrounding it, with the second sealing lip 22*a* provided on the free edge 11 of the hollow body 1; moreover, the flexible reeds 12 are collapsed, in as much as they are pushed down into the interspaces correspondingly intervening between them. Thus the ports 16 are occluded and the disc 15, as described above, effects a tight seal against the free edge 11. It should be added, furthermore, that the annular enlargement 11*a* effects a seal on the inner surface of the cap 6, thus creating an intermediate toroidal ring ensuring a perfect pneumatic tight closure and preventing the leak out of the liquid contents.

In order to remove the cap and open the bottle, the hood 6 is first screwed out, and it should be noted that, when the bottle is opened for the first time, during the unscrewing of the hood 6, the spot bridge connection is broken out. During this step, the reeds 12, which as mentioned hereinabove were in a collapsed condition, recover their initial position and push up on the disc 15, thus uncovering the ports 16. It may happen, however, that after a prolonged period of storage in the closed condition the elastic strain or deformation imparted to the reeds 12 would tend to convert into a plastic deformation, thus preventing the spontaneous erection of the reeds 12. In order to avoid this shortcoming, as the hood 6 is being screwed out, i.e. during the rotation thereof in a anticlockwise direction, the projections 21 cause the long appendages 18 to bend or flex leftwards, but since they are located in the proximity of the short appendages 17 preceding them in a clockwise direction, they cannot flex downwards as they do during the screwing in step of the hood. Since, as mentioned hereinabove, the short appendages 17 are substantially rigid, it occurs that when the long appendages rest thereon and activate the projections 21, the long appendages form a raised member, between the projections 21 and short appendages 17, which transmits an anticlockwise rotation to the shut off disc 15 as well. Said anticlockwise rotation of the shut off disc 15 performs the dual function of lifting up the flexible reeds 12 and imparting thereto a strain in an opposite direction with respect to the plastic deformation which they might have suffered during storage, thereby, when the hood 6 is fully removed by screwing out, the reeds 12 invariably take up a substantially vertical attitude, such as to leave uncovered the ports 16 and allow the liquid contents of the bottle to be poured out freely.

For closing the bottle after use, the hood 6 is obviously screwed down onto the hollow body 1, during which step the hood is rotated clockwise; as the hood is being turned down, the projections 21 act on the long appendages 18 and flex them rightwards and since, as already explained hereinabove, the long appendages are basically flexible, they do not oppose any appreciable resistance and thus do not impart any rotary motion to the shut off disc 15, thereby they act more or less like a freewheel arrangement. When the hood 6 is nearly fully screwed down, it acts on the shut off disc 15 compressing it downwards. This action causes the flexible reeds 12 to collapse to a fully lowered position in the interspaces therebetween.

From the above description it appears that the cap structure according to the invention fully achieves the objects intended, and in particular it should be stressed how it provides maximum reliability, since a tight seal fit is ensured between all its component parts, and above all it should be noted that the cap according to the invention comprises a very limited number of components, is easily and quickly installed on the neck of a bottle by means of automatic machines, thus favoring a marked reduction in the production costs for the assembling of the cap itself to a bottle.

The invention is susceptible to numerous modifications and variations, all of which fall within the scope of the instant inventive concept.

Furthermore, all the parts may be replaced with other elements of technically equivalent configurations.

In practicing the idea, the materials used may be any ones, although the best results are to be obtained through the use of plastic materials, and the dimensions may be selected to suit any particular applications.

We claim:

1. A safeguard cap structure particularly for bottles, comprising a cylindrical hollow body which can be associated in sealing engagement with the neck of a bottle, a threaded portion along the outer surface of said hollow body, a plurality of flexible reeds extending longitudinally in said hollow body in the proximity of the free edge thereof, a shut off disc supported by said reeds and forming with said free edge, outlet ports for a liquid contained in said bottle, said shut off disc being adapted to abut on said free edge in contrast to the force exerted by said reeds, a covering hood which may be screwed onto said threaded portion, said cap structure being characterized in that it comprises a plurality of short and rigid appendages and a plurality of long and flexible appendages arranged between the short ones, said appendages extending radially from the periphery of said shut off disc, projections being provided peripherally along the inner bottom of said covering hood and adapted to engage said long and substantially flexible appendages during the rotation of said covering hood.

2. A safeguard cap structure according to claim 1, characterized in that said long flexible appendages are arranged in the proximity of said short rigid appendages preceding the long ones in a clockwise direction, said long appendages being closer to said short preceding appendages than to said short appendages which follow in a clockwise direction.

3. A safeguard cap structure according to claim 1, characterized in that during the rotation of said hood in a clockwise direction, said projections engage with said long appendages thereby causing them to flex in the same direction and keeping said shut off disc from rotating; while during the rotation of said hood in an anticlockwise direction, said projections cause said long appendages to flex leftwards and rest them on said short appendages for imparting an anticlockwise rotation to said shut off disc.

4. A safeguard cap structure according to claim 1, characterized in that said long appendages are provided close to their roots with notches arranged oppositely and adapted to reduce the effective section of said appendages in order to increase the flexibility thereof and thus decrease the noise due to their vibration.

5. A safeguard cap structure according to claim 1, characterized in that said hood is provided at the bottom thereof with an annular thrust ridge which is effective to contact the upper face of said shut off disc.

6. A safeguard cap structure according to claim 1, characterized in that on the lower face of said disc, at said annular thrust ridge provided in said hood, there is provided a first annular sealing lip which acts on a second annular sealing lip provided on said free edge of said hollow body, when said disc is compressed against said free edge of said hollow body.

7. A safeguard cap structure according to claim 1, characterized in that said hollow body is provided at said free edge with an annular enlargement adapted to engage the inner cylindrical surface of said covering hood in order to achieve a tight seal.

8. A safeguard cap structure according to claim 1, characterized in that within said covering hood and through said annular enlargement, said first and second annular sealing lips, and the inner surface of said covering hood there is defined an intermediate toroidal pneumatic seal ring.

9. A safeguard cap structure according to claim 1, characterized in that said cylindrical hollow body can be associated to a bottle neck through an annular flange provided at the bottom portion of said hollow body which can be associated with said bottle neck through a collar, there being provided on the lower face of said annular flange an annular outer edge which is thrust in and locked between said collar and said bottle neck, when said collar is mounted on said neck.

10. A safeguard cap structure according to claim 1, characterized in that it comprises on the lower face of said annular flange an inner annular edge which is concentric to said outer annular edge and achieves a tight seal between said annular flange and said neck.

11. A safeguard cap structure according to claim 1, characterized in that it comprises, sawtooth raised portions spaced uniformly along said collar, which are adapted to engage sawtooth appendages provided on said annular flange of said hollow body in order to prevent any counter-rotation in a clockwise direction with respect to said collar.

12. A safeguard cap structure according to claim 1, wherein said flexible reeds are provided with a longitudinal enlargement at their areas of connection to said hollow body.

13. A safeguard cap structure according to claim 1, wherein said flexible reeds extend downwards, each of them within an essentially triangular plate to serve as an engagement member for an automatic puncher, located externally thereto and adapted to screw said hollow body down into said hood.

14. A safeguard cap structure according to claim 1, characterized in that it comprises at least one first set of flexible tabs arranged along a circumference and adjacent to one another, said tabs extending substantially longitudinally from said shut off disc within said hollow body.

15. A safeguard cap structure according to claim 14, characterized in that it comprises a second set of flexible tabs arranged adjacently to one another along a circumference which extends externally and concentrically to the circumference of said first set of tabs, said tabs of second set being arranged in an offset configuration with respect to said tabs of said first set.

16. A safeguard cap structure according to claim 1, characterized in that said covering hood is manufactured as a single component together with said collar for assembling the cap to the neck of a bottle, the lower edge of said hood being connected to said collar by means of tear away spot bridges.

17. A safeguard cap structure according to claim 1, characterized in that on the inner surface of said collar, close to its lower end, there are provided projections for allowing the preliminary positioning of said collar on said bottle neck.

* * * * *